US011555286B1

(12) United States Patent
Nelson et al.

(10) Patent No.: US 11,555,286 B1
(45) Date of Patent: Jan. 17, 2023

(54) STABILIZING STRUCTURAL FILLS

(71) Applicants: Leonard Nelson, Raleigh, NC (US); Matthew Dwain Campbell, Cary, NC (US); Rachel Nelson, Raleigh, NC (US)

(72) Inventors: Leonard Nelson, Raleigh, NC (US); Matthew Dwain Campbell, Cary, NC (US); Rachel Nelson, Raleigh, NC (US)

(73) Assignee: Natrx, Inc., Cary, NC (US)

( * ) Notice: Subject to any disclaimer, the term of this patent is extended or adjusted under 35 U.S.C. 154(b) by 0 days.

(21) Appl. No.: 17/652,644

(22) Filed: Feb. 25, 2022

(51) Int. Cl.
*E02D 17/20* (2006.01)
*E02D 3/12* (2006.01)

(52) U.S. Cl.
CPC ..... *E02D 17/20* (2013.01); *E02D 3/12* (2013.01)

(58) Field of Classification Search
CPC . E02B 3/14; E02B 3/129; E02D 17/20; E02D 17/205; E02D 3/005; E02D 3/12
See application file for complete search history.

(56) References Cited

U.S. PATENT DOCUMENTS 2,766,592 A * 10/1956 Danel ..... E02B 3/129 405/29
2,909,037 A * 10/1959 Palmer ..... E02B 3/129 405/29
3,091,087 A * 5/1963 Danel ..... E02B 3/129 405/29
3,252,287 A * 5/1966 Suzuki ..... E02D 29/02 52/611
3,355,894 A * 12/1967 Vidal ..... E02B 3/129 405/29
3,380,253 A * 4/1968 Vita ..... E02B 3/129 D25/113
3,456,446 A * 7/1969 Kusatake ..... E02B 3/129 D25/113
3,614,866 A * 10/1971 Kaneko et al. ..... E02B 3/129 405/29
3,636,713 A * 1/1972 O'Neill ..... E02B 3/129 405/29
3,896,624 A * 7/1975 Chang ..... E02B 3/129 405/29
3,898,761 A * 8/1975 Zohar ..... A63H 33/04 446/85
4,664,552 A * 5/1987 Schaaf ..... E02B 3/123 405/20

(Continued)

OTHER PUBLICATIONS

Max, How to use Rockwool Cubes for Growing, Seed Starting, and Cutting Propagation, https://www.trees.com/gardening-and-landscaping/rockwool-cubes, Feb. 1, 2021.

(Continued)

*Primary Examiner* — Benjamin F Fiorello
(74) *Attorney, Agent, or Firm* — John B. Edel; Edel Patents LLC

(57) ABSTRACT

Stabilized structures and fills are disclosed relating to erosion control that include multiple interlock units and fibers that interact with those interlock units. Combinations of interlock units, fibers, and other optional fill materials may be used to stabilize a vulnerable earthen slope. Various fiber tensions act on the interlock units tending to hold the interlock units together and tending to hold the interlock units in position on the slope.

20 Claims, 9 Drawing Sheets

(56) References Cited

U.S. PATENT DOCUMENTS 5,080,526 A * 1/1992 Waters ..... E02B 3/129 405/16
5,160,215 A * 11/1992 Jensen ..... E01C 3/06 404/46
5,190,403 A * 3/1993 Atkinson ..... E02B 3/129 405/21
5,441,362 A * 8/1995 Melby ..... E02B 3/129 405/16
5,556,230 A * 9/1996 Turk ..... E02B 3/129 405/21
5,971,658 A * 10/1999 Pramono ..... E02B 3/123 405/20
7,160,057 B2 * 1/2007 Reedijk ..... B28B 7/0029 405/25
7,699,560 B2 * 4/2010 Hoebe ..... E02B 3/124 405/35
8,529,153 B2 * 9/2013 Folgado ..... E02B 3/14 405/16
9,962,855 B2 5/2018 Campbell et al.
10,745,878 B2 * 8/2020 Reedijk ..... E02B 3/14
2008/0298894 A1 * 12/2008 van den Berge ..... E02B 3/129 405/21
2010/0104366 A1 * 4/2010 Melby ..... E02B 3/129 405/16
2010/0104379 A1 * 4/2010 Amuchastegui ..... E02B 3/129 405/302.6

OTHER PUBLICATIONS

D. C. Froehlich, Sizing Loose Rock Riprap to Protect Stream Banks, River Research and Applications, Wiley Online Library, Published online Nov. 10, 2011.
Vegetated Riprap, https://dirttime.tv/wp-content/uploads/2018/04/Vegetated-Riprap.pdf, Date unknown.

* cited by examiner

STABILIZING STRUCTURAL FILLS

Stabilizing structural fills described herein may be used in the stabilization of earthen slopes and more generally in erosion protection. Certain stabilizing structural fills disclosed herein include interlocking units and fibers that interact with the interlocking units to create stabilizing forces.

DETAILED DESCRIPTION

Principles and Examples

Figure 1A:
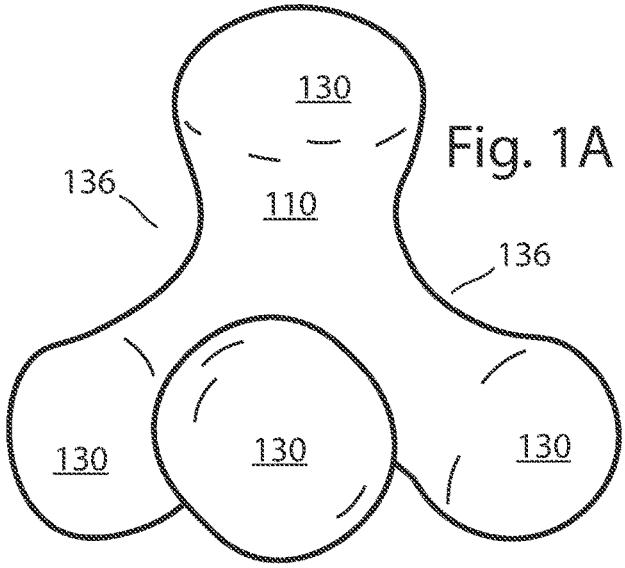
FIGS. 1A, 1B, 1C, and 1D show four separate rotated views of an interlock unit.
Figure 1B:
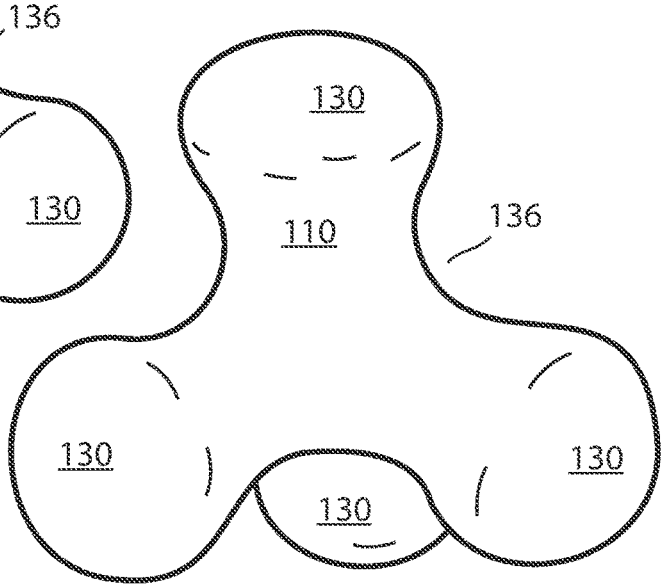
Figure 1C:
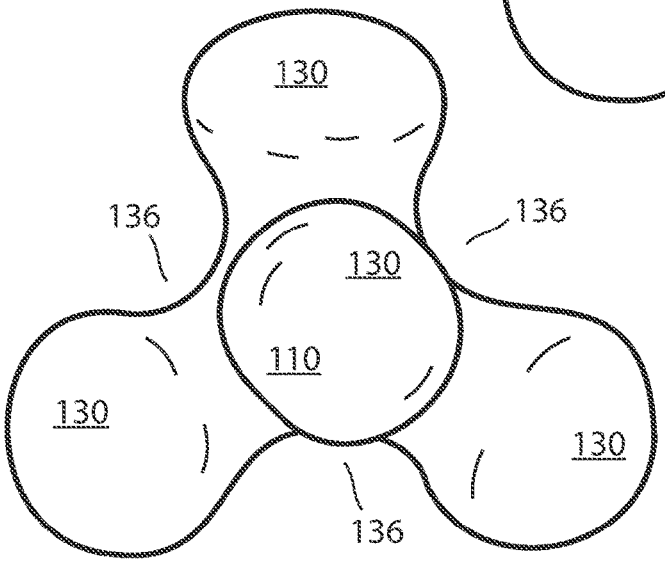
Figure 1D:
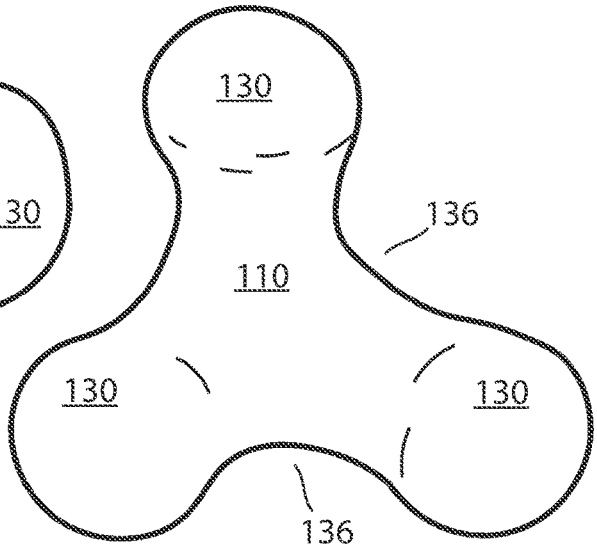

Vulnerable earthen slopes may be protected and/or stabilized by the utilization of interlock units along with fibers as described herein. The associated structures and relationships between the various elements involved may be understood by reference to special terminology characterizing those structures and relationships along with reference to the drawings.

As that phrase is used herein "vulnerable earthen slope" indicates a surface having solid natural materials and having a grade of at least 20% which is subject to erosion. Vulnerable earthen slopes described as herein may be located in a great diversity of locations including dry land, underwater, tidal areas, shorelines, waterways, and intermittently inundated locations.

As that phrase is used herein, an "interlock unit" is a unit capable of an interlock with an identical unit. The term "interlock" and the corresponding term "interlocked" both designate engagement between two interlock units in which the interlock protrusion of one interlock unit is within the interlock recess of another interlock unit; provided that neither interlock unit is so small that it can entirely fit within the interstitial space of the other interlock unit. The phrase "interlock protrusion" indicates a protruding part of the rigid portion of an interlock unit capable of protruding by greater than 1% of the unit length of that interlock unit into an interlock recess of a hypothetical identical interlock unit. Similarly, the phrase "interlock recess" indicates a recess from the interlock boundary within the interstitial space of an interlock unit into which the rigid portion of a hypothetical identical interlock unit may protrude by greater than 1% of the unit length. As used herein, the phrase "interstitial space" indicates the space outside of a rigid portion of an interlock unit that may be found between two points of the rigid portion of an interlock unit. Further, the phrase "interlock boundary" indicates the boundary between the interstitial space of an interlock unit and the space beyond the interstitial space of the interlock unit.

As used herein, the phrase "interlock extent" is a measure of the degree of interlock into an interlock recess of an interlock unit measured as the distance of penetration into the interstitial space of the interlock unit having the relevant interlock recess. Interlock extent may be measured by actual distance, such as centimeters, or by percentage of the unit length of the interlock unit with the relevant interlock recess. As that phrase is used herein, a first interlock unit having an interlock extent of 8% into a second interlock unit signifies an interlock protrusion of the first interlock unit extending beyond the interlock boundary of the second interlock unit by a distance equivalent to 8% of the second interlock unit's unit length.

As used herein, the phrase "unit length" indicates the longest straight-line dimension of the rigid portion of an interlock unit. This measurement does not include fibers protruding from the rigid portion of the interlock unit. As used herein, the phrase "large interlock recess" indicates a recess from the interlock boundary within the interstitial space of an interlock unit into which a hypothetical identical interlock unit may protrude by greater than 5% of the unit length. As used herein, the phrase "small interlock recess" indicates an interlock recess that is not a large interlock recess.

FIGS. 1A, 1B, 1C, and 1D each depict an Interlock unit 110. These interlock units, as depicted have four interlock protrusions with Interlock protrusions 130 configured to maximize the spatial separation from the other interlock protrusions. The geometry of the interlock protrusions may be configured somewhat similarly to tetrapod units commonly used to prevent coastal erosion and may have Interlock recesses 136.

Figure 2:
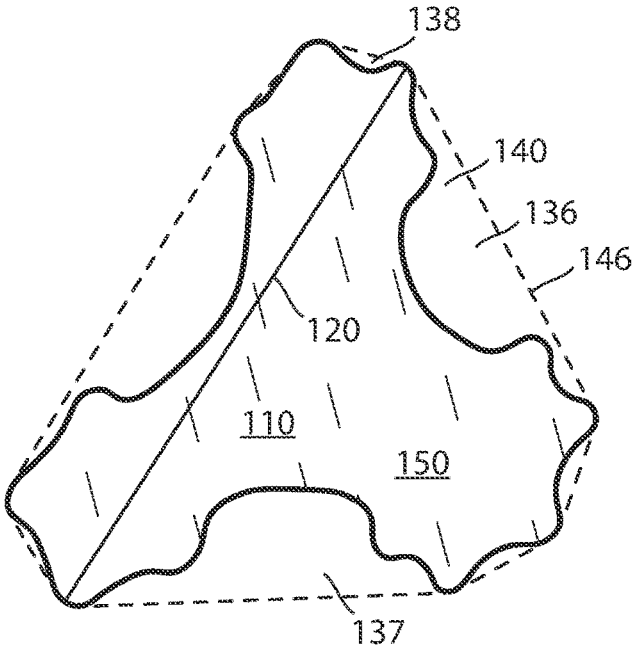
FIG. 2 shows a cross section of an interlock unit.

FIG. 2 depicts a cross section of an interlock unit showing a plane that includes a line containing the Unit length 120. Interlock boundary 146, as described above, surrounds the Interstitial space 140. Interlock recesses 136 appear between Rigid portion 150 of Interlock unit 110 and Interlock boundary 146. Interlock recesses may appear as a Large interlock recess 137 or a small interlock recess 138.

Figure 3:
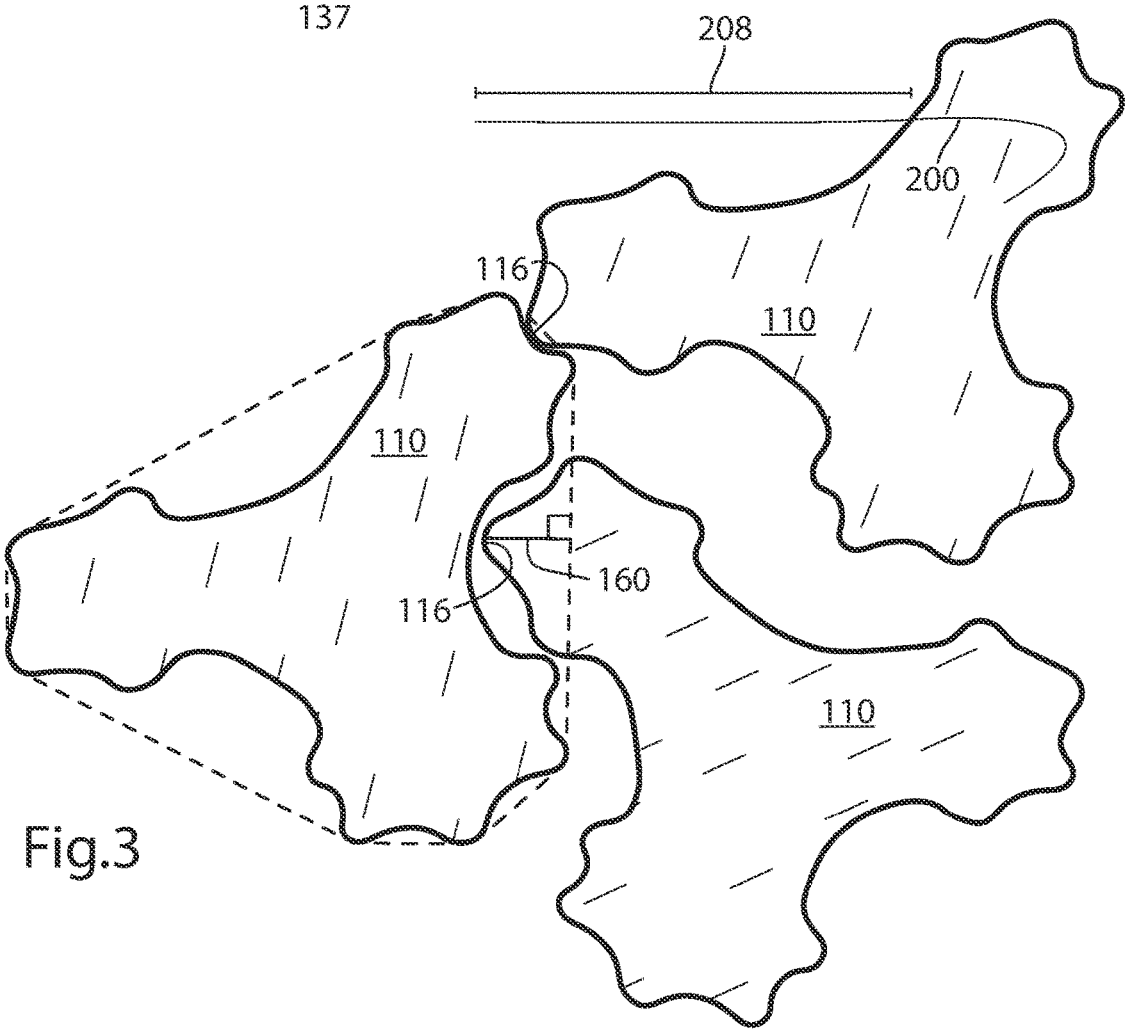
FIG. 3 shows cross-sections of three interlock units interacting with one another.

FIG. 3 depicts an Interlock extent 160 between one Interlock unit 110 and another Interlock unit 110. This figure is shown in cross-section and the selected cross-section represents the greatest extent of Interlock 116 between the interlock units.

Protruding from the remaining Interlock unit 110 is Integral fiber 200 pulled straight to demonstrate the Fiber external length 208. Interlock units having protruding integral fibers commonly have much greater than a single protruding integral fiber. The presentation of a single fiber in the figure is for illustrative purposes.

Figure 4:
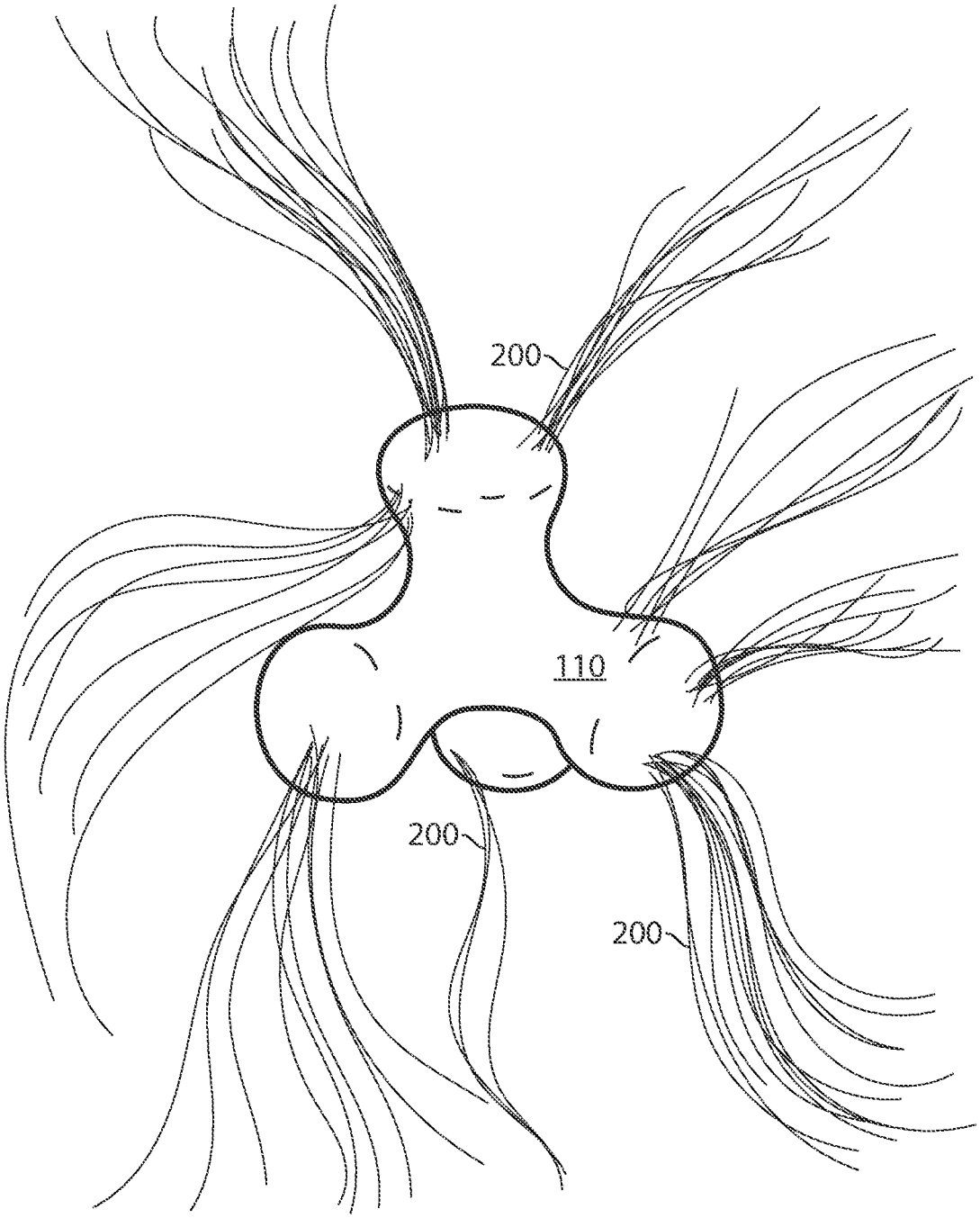
FIG. 4 shows an interlock unit with protruding integral fibers.

FIG. 4 depicts an Interlock unit 110 with a multitude of Protruding integral fibers 200. Protruding integral fibers may completely cover the body of an interlock unit, occur in bunches, appear randomly, or appear in patterns. Interlock units may also exist without integral fibers. Fibers may have lengths greatly exceeding those shown by the proportions indicated in the drawing.

In cases where fiber is protruding from interlock units, one way in which the extent of the fibers may be characterized is a fiber protrusion volume. The "fiber protrusion volume" of an interlock unit is the total volume that the fibers attached to the interlock unit could reach outside of the rigid portion of the interlock unit if those fibers were allowed to travel through their full range of possible motion. Any evaluation of fiber protrusion volume should be conducted such that nothing inhibits the motion of the fibers around the interlocking unit. In other words, the interlock unit should be evaluated as suspended away from the ground and other obstructions. The fiber protrusion volume may be evaluated as compared to the volume of the rigid portion of the interlocking unit. The fiber protrusion volume may be greater than 50% of the volume of the rigid portion of the interlocking unit. In many cases the fiber protrusion volume is greater than 100% of the volume of the rigid portion of the interlocking unit. In certain cases, the fiber protrusion volume may be greater than 300% of the volume of the rigid portion of the interlocking unit. In still other embodiments, the fiber protrusion volume may be greater than 1,000% of the volume of the rigid portion of the interlocking unit.

Figure 5:
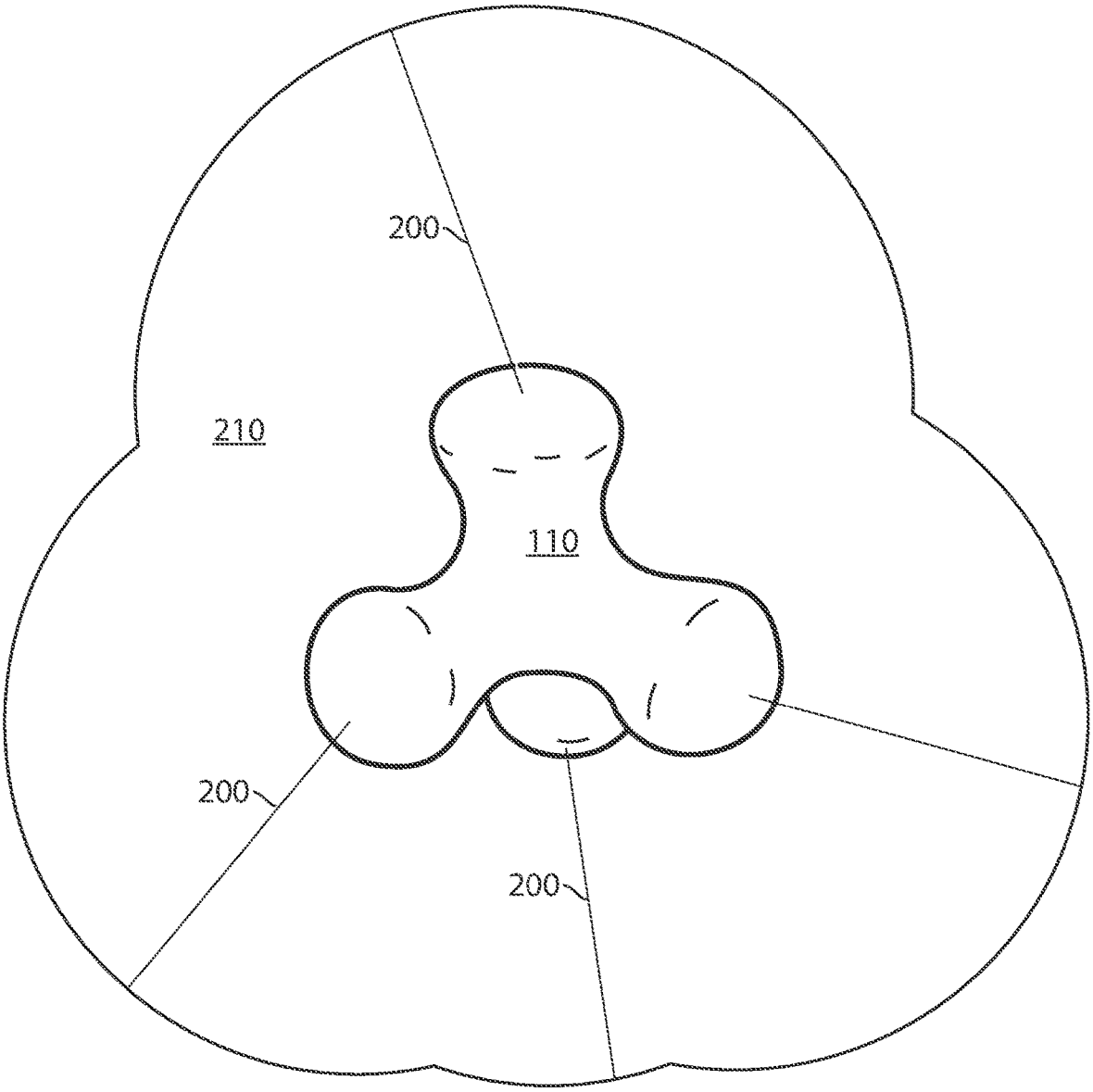
FIG. 5 shows an interlock unit with protruding integral fibers.

FIG. 5 depicts an Interlock unit 110 and a Fiber protrusion volume 210 surrounding the Interlock unit 110. Protruding integral fibers 200 are depicted as straight and without adjacent fibers to better illustrate the connection between Fiber protrusion volume 210 and Protruding integral fibers 200.

To define the directions that fibers pull on interlock units supported on a slope, the x-axis direction is defined as the horizontal direction most closely associated with uphill such that x-axis values become more positive in that direction. For brevity, the direction of the x-axis is referred to herein as the "horizontal uphill direction." The y-axis direction is vertical, and the z-axis direction is the horizontal direction parallel to the slope. As used herein the phrase "principal stabilizing tension" designates a tension acting on the interlock unit in which a resolution of the tension force into components along the x, y, and z axes produces an x-component force that is positive and has a magnitude greater than ¾ of the total unresolved tension force in addition to the total unresolved force being greater than 1/100 of weight of the interlock unit.

Figure 6:
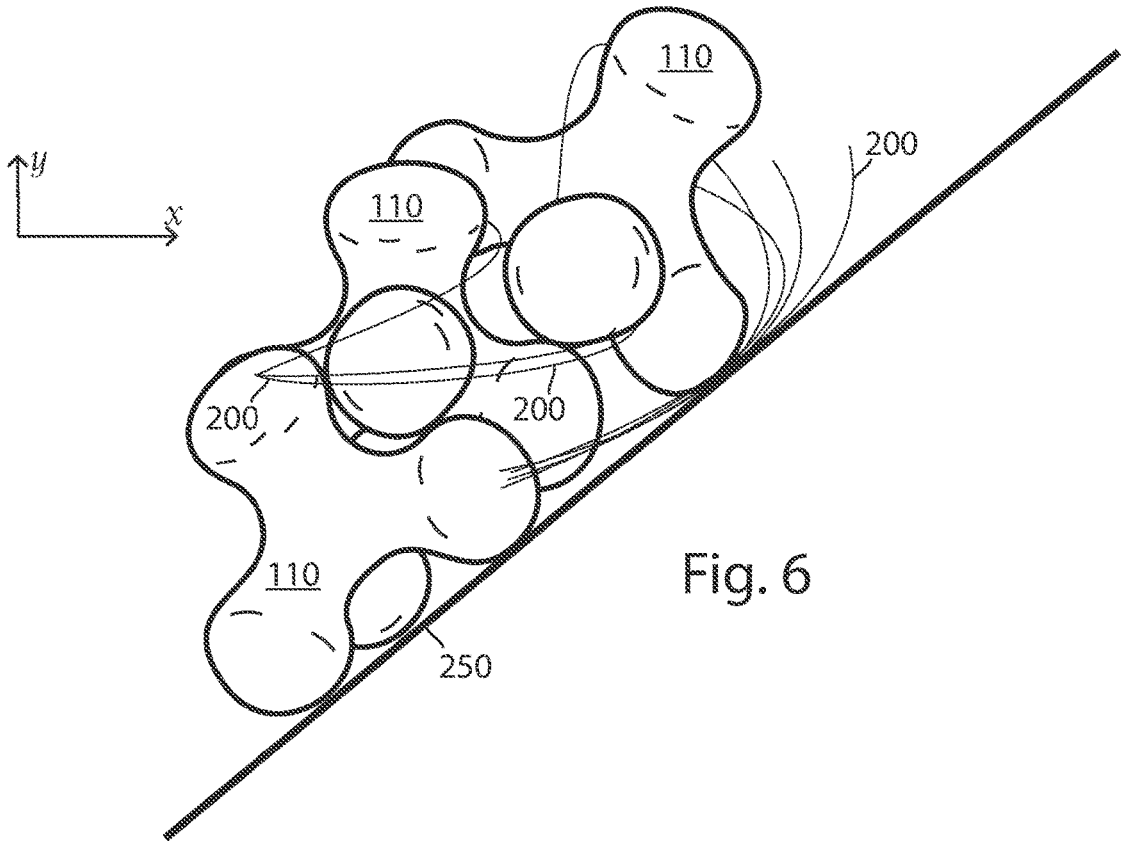
FIG. 6 shows three interlock units engaged with one another on a vulnerable earthen slope along with associated fibers.

FIG. 6 depicts three Interlock units 110 configured on a Vulnerable earthen slope 250. Protruding integral fibers 200 are depicted only for the interlock unit furthest down the slope. Only select protruding integral fibers out of a potentially large number of fibers on that unit are depicted for clarity.

The units may be placed in such a way that the fibers are biased away from the interlock unit in the horizontal uphill direction. Moving the interlock units down the slope and allowing the fibers to trail behind the interlock unit during the downhill motion is one method for accomplishing this bias in the fiber. As successive interlock units place weight on and entangle with the fibers of other units, tensions developed in the fibers. Interlocking units with fibers that pull with even a fraction of the tension force in the horizontal uphill direction tend to stabilize the interlock unit on the slope. Interlocking units with fibers that pull the interlock unit with a fraction of the tension force toward the vulnerable earthen slope may also tend to stabilize the interlock unit on the slope. Interlocking units with protruding integral fibers that exert a principal stabilizing tension on the interlock unit tend to both increase the stability of the interlock unit and increase the stability of the slope.

Figure 7:
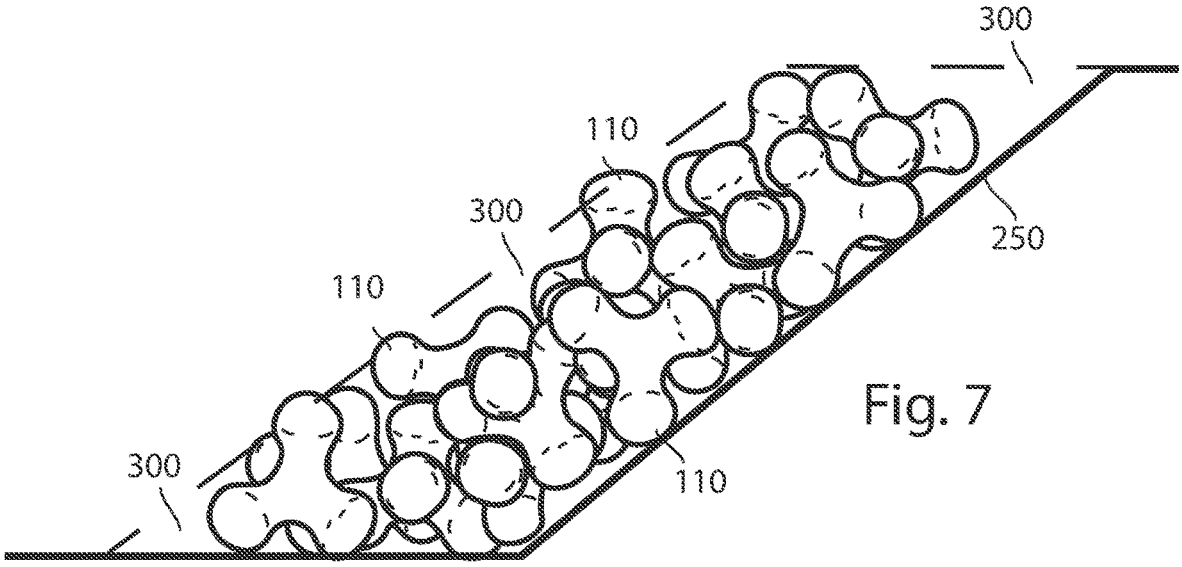
FIG. 7 shows several interlock units engaged with one another as an installation on a vulnerable earthen slope.

FIG. 7 depicts Interlock units 110 situated on Vulnerable earthen slope 250. Fill space 300 encompasses the majority of the interlock units. Interlock units 110 may have integral fibers and Fill space 300 may have loose fibers, but those fibers are not depicted in this drawing to preserve the clarity of the drawing.

The depth of the fill used in installations described herein may completely cover all interlock units, partially cover at least a portion of all of the interlock units, completely cover the majority of interlock units, or partially cover at least a portion of the majority of interlock units. In certain cases, the interlock units may be installed without additional fill, in which case soil and other earthen materials may accumulate around the interlock units and the trap by the fibers.

As that phrase is used herein "fill material" designates a material used to fill a space as part of an earthwork or civil construction. Fill material, as used herein, designates a material composition originating from at least 10 meters from its final fill location as applied, whether it is homogenous or heterogeneous. Thus, a sand gravel mix that originated from off-site dumped from a truck would be a fill material. Separate compositions applied separately to their final positions are always regarded herein as separate fill materials. Accordingly, when applying a layer of rocks and then applying a layer of sand over the rocks the resulting sand and rock composition would not be referred to as a fill material, it should be regarded as two separate fill materials.

To define the directions that fibers pull on interlock units relative to each other in an interlock, the x'-axis direction is defined as the direction perpendicular to the interlock boundary such that x' is the axis along which the interlock extent is measured. The axes y' and z' would be perpendicular to the x'-axis. As used herein the phrase "principal interlocking tension" designates a tension acting on an interlock unit in which a resolution of the tension force into components along the x', y', and z' axes produces an x'-component force that has a magnitude greater than ½ of the total force.

As that phrase is used herein "fiber secured interlock" designates an interlock between interlock units in which one or more fibers exert a principal interlocking tension on one of the interlock units and the total tension exceeds 1/100 of the mass of the lesser of the two interlock units. Interlock units in installations described herein may have one or more fiber secured interlocks and one or more fibers exerting a principal stabilizing tension.

Figure 8:
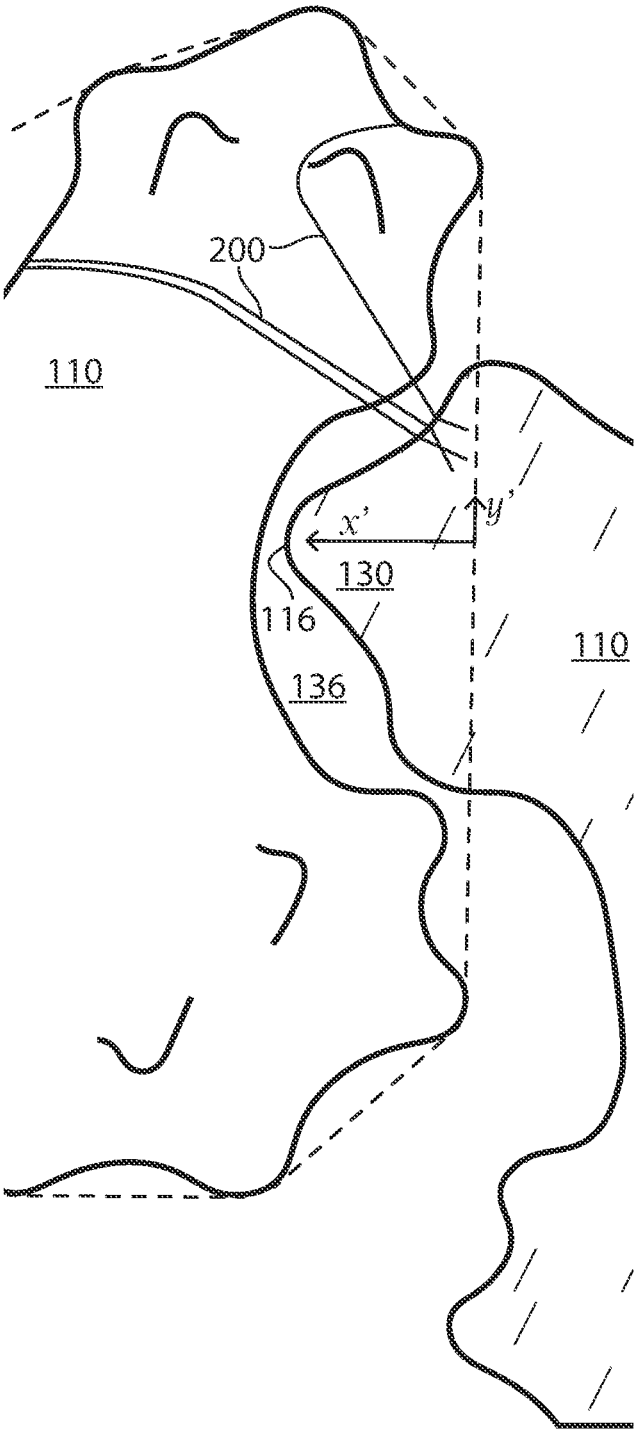
FIG. 8 shows an interaction between two interlock units in interlock.

FIG. 8 depicts an interaction between two Interlock units 110 in Interlock 116. Interlock protrusion 130 of the rightmost interlock unit penetrates Interlock recess 136 of the leftmost unit. The two interlock units of FIG. 8 are depicted in a configuration similar to that of FIG. 3, but with only the rightmost unit being shown in cross-section. Protruding integral fibers 200 protrude from the interior of the rightmost interlock unit and wrap around the leftmost interlock unit. Those fibers collectively and individually create tension forces tending to hold the Interlock protrusion 130 within the Interlock recess 136. Fibers 200 could be characterized as exerting a principal interlocking tension either individually or collectively. The principal interlocking tension may be characterized as acting on either the leftmost interlock unit or the rightmost interlock unit.

As the interlock units engage each other in an installation, the fibers create tensions on the interlock units such that a single interlock unit may have one or more fibers creating principal interlocking tension on the interlock unit and one or more other fibers creating a principal stabilizing tension on the unit. The greater the number of interlock units with a principal interlocking tension, principal stabilizing tension, or both the greater the stability of the slope.

Protruding Integral Fiber Examples

Examples below generally involve—but do not necessarily involve—protruding integral fibers.

U.S. Pat. No. 9,962,855, issued May 8, 2018, describes a printing method that may be used in the preparation of interlock units and the teachings of that patent are hereby incorporated by reference into the present application. For example, an interlock unit may be printed in three-dimensional form by positioning a series of nozzles within a bed of loose solid material including fibers, which may contain cement, and moving the series of nozzles through the bed of loose solid material while emitting liquid according to a predetermined pattern. Reaction of the liquid with the bed of loose solid material may form a solid three-dimensional object that is an interlock unit. The interlock unit may then be removed from the remaining unreacted solid material. In the case where the bed of loose solid material contain cement, a concrete interlock unit may be formed. The selection, characteristics, and distribution of fibers in the loose solid material may be varied to produce interlock units having protruding integral fibers. A tremendous variety of interlock units may be formed according to this method. Further, interlock units with no protruding integral fibers or interlock units with minimal protruding integral fibers may be produced for use in embodiments described herein.

Interlock units may be formed by placing concrete over and through fibers having a variety of configurations including, for example, over a mat of fibers such as a basalt rock fiber mesh and allowing the concrete to harden with the mesh protruding from the finished concrete structure. Interlock units may also be prepared from slurry-based concrete and may be prepared on-site or off-site. Interlock units may further be prepared using shotcrete to attach loose fibers to a structure in a way that creates integrated fibers. A great variety of known preparation methods associated with concrete and other similar materials may be adapted based on the disclosures herein to prepare or produce interlock units having protruding integral fibers with characteristics described herein.

Interlock units having features described herein may be produced by slurry extrusion or known concrete printing methods accompanied by blown fibers. In such embodiments fibers may be applied in alternating vertical layers during the printing process. For example, a slurry of cementitious-like mix may be extruded through a 3d printer head, operating in three dimensional (x, y, z) space with "z" representing the vertical dimension. As layers of the shape are placed, fibrous materials could be blown or applied on top of each layer or selected layers causing protrusions from the shape as additional layers create alternating patterns of cementitious material with fibers that could protrude out from the shape as it forms upwards in the z-direction layer by layer. Such embodiments may be easily adapted to traditional extrusion 3D printers, may enable the application of very long fibers to the system, and may enable a large number of nodes with fibrous protrusions depending on the size of the interlock unit. As that term is used herein, "node" designates a unit of the printing or interlock unit creation process comparable to a pixel. Protruding fibers from layer-based 3D cementitious printing would commonly have fibers protruding primarily in the x-y plane, as printed. Having multiple layers of fibers spreading out with each layer primarily spreading in two dimensions may be advantageous when the desirable fiber interactions within an installation are located in the directions the fibers naturally spread.

Precast interlock units may be integrated into a fiber grid or other preconfigured fiber arrangement. In such examples, a slurry mix may be cast into a mold which includes a grid or matrix of fibrous materials that protrude both inside and outside the mold. A simple example of this approach would be a double cup type mold that includes a bottom cup portion of the mold, a fibrous matrix placed on top of the bottom cup mold and protruding from the sides, and a top cup mold that is placed upside down, with the cup opening facing down. The top cup mold may have an injection hole that allowing a slurry mix to be added. The result of such a configuration would be a hardened structure with a fibrous grid or matrix protruding from outside that structure. The hardened structure may have the characteristics of an interlock unit. However, a variety of hardened structures having protruding fibers may be used with significant advantages in installations described herein regardless of whether those hardened structures qualify as interlock units. Such casting techniques may be advantageous because they may be used along with other techniques associated with precast concrete. Mold design may be optimized to align breaking points between mold parts in such a way that the location and direction of protruding integral fibers creates fiber interactions that enhance the stability of relevant installations.

Interlock units and other hardened structures having protruding integral fibers may be prepared with shotcrete. In such embodiments, cementitious slurry may be sputtered through shotcrete application equipment or by similar methods onto a flat surface or an engineered surface while fibers are being applied through a blower or by some other application technique. In shotcrete type applications the shotcrete blower may be pointed at a specific point to concentrate the application of cementitious-like slurry towards a node. Simultaneously a fibrous material blower or another fibrous material application technique may be used to apply fibers while the shotcrete is being applied. When a sufficient mass of slurry and fibers have formed together to make a node, the node may be allowed to harden the slurry and fibers can be then applied to the next node. This type of technique may form chunks of hardened materials with protruding fibers. As with other techniques that form concrete or cement boundaries without the aid of a form, surface roughness may develop at the node scale and at a smaller scale. These various scales of roughness may contribute to the stability of the ultimate installation.

Fiber insertion may be used to create interlock units and other hardened structures having protruding integral fibers. In such cases fibers may be inserted into a slurry mix. Fibers may be mechanically inserted into the top of a curing slurry mix. This approach allows for the addition of fibers in specific locations and may allow for direct control over the depth of insertion and the orientation of fibers in the final unit produced. In one example, a mechanical technique for insertion may be comparable to a rice transplanting machine. Fiber insertion techniques may be compatible with a large number of casting and other concrete placing techniques allowing interlock units and other hardened structures having protruding integral fibers to be produced with a high level of final strength.

The rigid portion of interlock units may be constructed from cementitious materials including concrete or other conventional substitutes for concrete such as materials bound by biopolymers. In such cases the binder may be a man-made binder. The principal binder in an interlock unit may be cement or a man-made polymer. Rigid portions of interlock units may have significant structural strength and that strength may be measured by metrics frequently used to evaluate the strength of concrete. Indications regarding the strength of the rigid portion of an interlock unit herein indicate average strength and when strength is variable across the rigid portion of an interlock unit sufficient sampling should be done to evaluate average strength. The rigid portion of an interlock unit may have an average compressive strength exceeding 800 psi. In some cases, the average compressive strength may exceed 4000 psi according to ASTM standard C39. The rigid portion of an interlock unit may have flexural strength of greater than 400 psi based on testing according to ASTM C1609. The rigid portion of an interlock unit may have a flexural strength of greater than 1000 psi based on that standard and some examples may have a flexural strength of greater than 2000 psi.

In addition to concrete, many other materials may be used in the formation of interlock units. Cementitious materials may be used to form the interlock units. Many Geo polymers may be utilized in the formation and alkali activated aluminosilicates may be used. Polymers and cements including fly ash may also be used to form the interlock units.

The number of shapes that may qualify as interlock units are too numerous to mention or individually characterize. Some common examples include tetrapods. Other unit configurations known in the field of coastal protection, and in many cases recognized by the Army Corps of Engineers, such as the concrete armor unit shapes identifiable as: akmon, bipod, cob, modified cube, dolos, gassho, tripod (of cubes), grobbelaar, hexaleg (cube form), hexapod, hollow square, hollow tetrahedron, interlocking h-block, tripod, n-shaped block, pelican stool, quadripod, stabit, sta-bar, sta-pod, tri-long, stock cube, svee, tetrahedron (solid), tetrahedron (solid), tetrahedron (perforated), tetrapod, toskane and tribar. Depictions of examples of these shapes may be found in *Marine Concrete Structures* (pp. 17-64, Woodhead Publishing)

Figure 9:
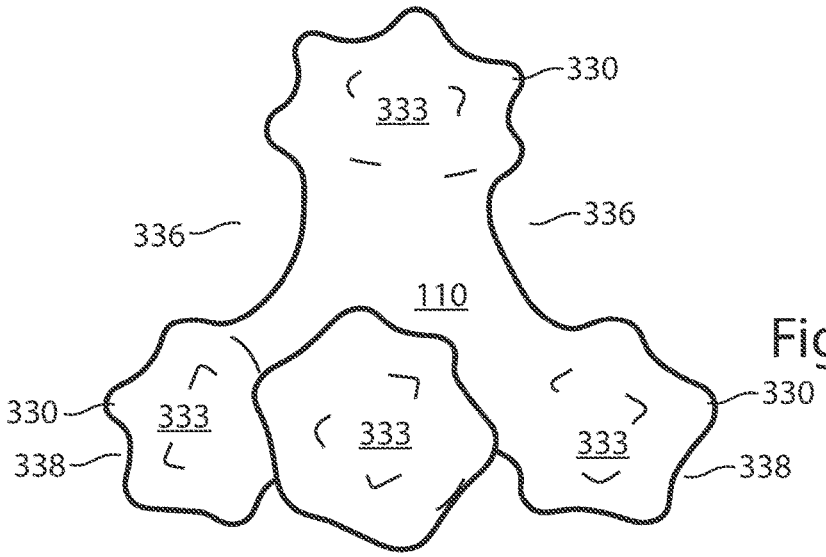
FIG. 9 shows an interlock unit configured with cleats.

FIG. 9 depicts an Interlock unit 110 configured with Cleats 330, being smaller interlock protrusions, protruding from Large interlock protrusions 333 and having both Large interlock recesses 336 and Small interlock recesses 338. The interlock unit depicted is in the general form of a tetrapod unit.

Figure 10A:
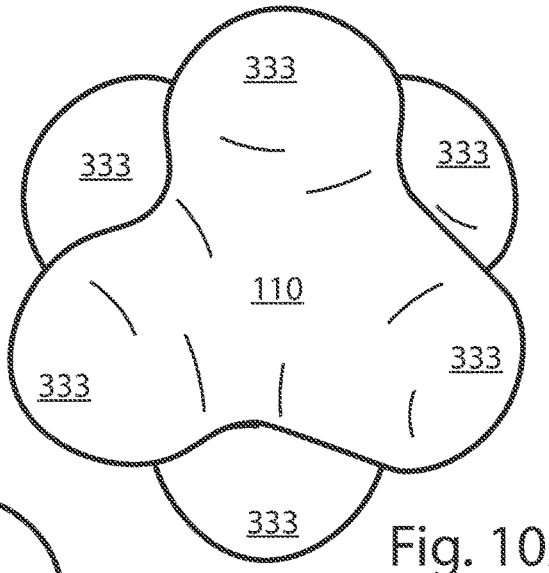
FIGS. 10A and 10B depict different views of an interlock unit having six large interlock protrusions.
Figure 10B:
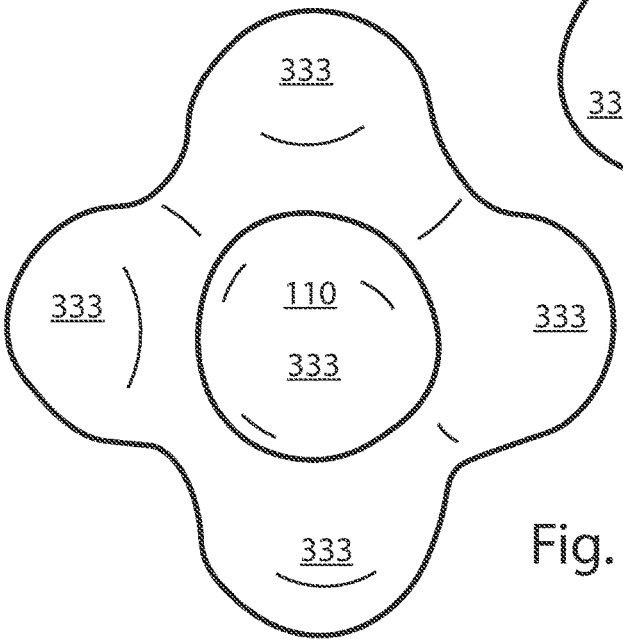

FIGS. 10A and 10B depict different views of an Interlock unit 110 having six Large interlock protrusions 333. The direction of protrusion of the interlock protrusions may be nearly equally spaced from one another about the center of the interlock unit.

Figure 11A:
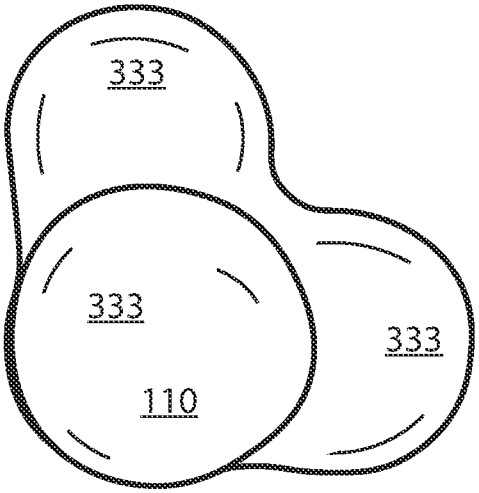
FIG. 11A depicts a side view of an interlock unit having four large interlock protrusions.
Figure 11B:
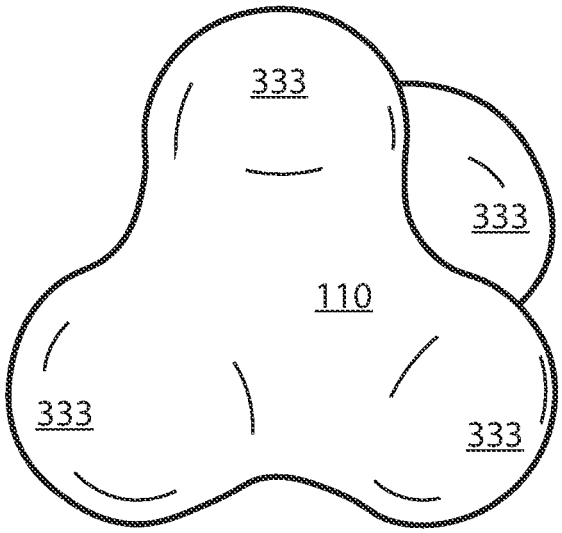
FIG. 11B depicts a perspective view of an interlock unit having four large interlock protrusions.
Figure 11C:
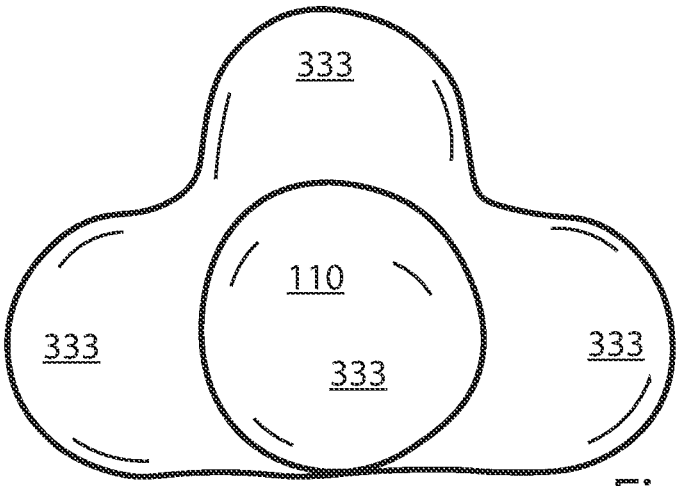
FIG. 11C depicts a front view of an interlock unit having four large interlock protrusions.

FIGS. 11A, 11B, and 11C depict different views of an Interlock unit 110 having four Large interlock protrusions 333. Two of the protrusions are along a common axis and the other two protrusions are both normal to each other and normal to the common axis.

Figure 12:
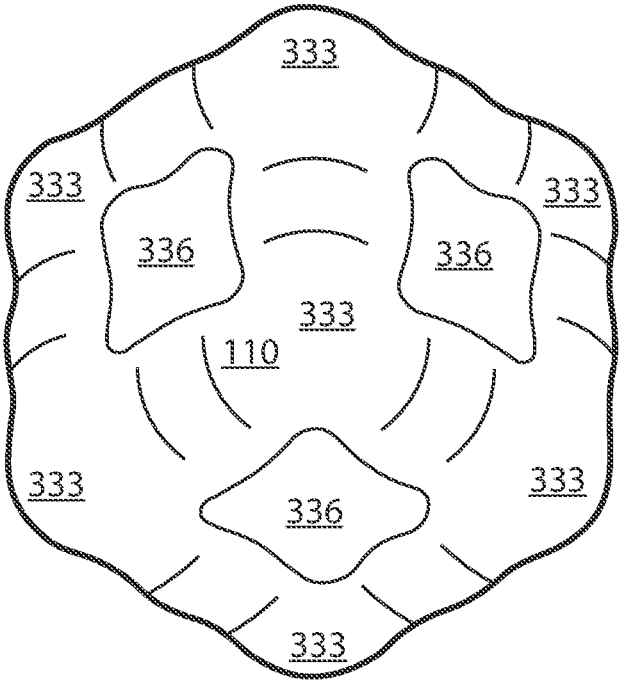
FIG. 12 depicts an interlock unit having the general form of a cube.

FIG. 12 depicts an Interlock unit 110 having the general form of a cube; eight Large interlock protrusions 333, three of which are shown; and six Large interlock recesses 336, seven of which are shown. The Large interlock protrusions 333 are generally located where the faces of a typical cube would otherwise be located.

Each of FIGS. 9, 10A, 10B, 11A, 11B, 11C, and 12 depict interlock units without protruding fibers. These interlock units may be prepared with or without protruding integral fibers and they represent only a tiny fraction of potential interlock unit configurations compatible with the embodiments described herein.

In some cases, the exterior shape of an interlock unit may be characteristic of a diffusion boundary as may be the case with interlock units prepared according to the methods described in U.S. Pat. No. 9,962,855. As that phrase is used herein, "diffusion boundary" designates a boundary formed by the extent of liquid diffusion within a bed of loose solid material such as the exterior boundary of a printed interlock unit. In that case, the exterior surface of the rigid portion of the interlock unit would be the diffusion boundary. These diffusion boundaries may benefit the overall structural integrity of a final installation according to the methods described herein due to the associated increased friction coefficient and the increased roughness of the exterior. In such cases, the diffusion boundary may create small interlock recesses. Further, individual pixels produced by the printing process according to that patent may also create small interlock recesses.

Interlock units may come in the form of C-shaped units, crescents or other shapes known to form interlocks according to the standards set out herein.

Fibers described herein may be basalt fibers, or other fibers having similar characteristics. Fibers may also be constructed from mineral wools, rockwool, glass fibers, natural fibers such as jute fibers, coir fibers, and cotton. Fibers may come from virgin or recycled materials. In certain embodiments glass fibers such as alkali resistant glass fibers may be used. Many polymer or plastic fibers may be used in in conjunction with the embodiments described herein. The fibers may be plant fibers or animal fibers. The fibers may be living fibers or formerly living fibers. The fibers may be carbon-based fibers characterized by the presence of covalently bonded carbon atoms. The fibers may be synthetic or non-synthetic fibers. Example synthetic fibers may include nylon, polyamide nylon, polyethylene terephthalate, polybutylene terephthalate, polyester, phenol-formaldehyde, polyvinyl chloride fibers including vinyon, polyolefins such as polypropylene and polyethylene, polyesters, acrylic polyesters, polyacrylonitrile fibers and carbon fibers. In certain examples and applications, installations may be constructed without any synthetic fibers.

As that phrase is used herein, "integral fibers" indicates fibers that have a portion of the fiber fixed within the rigid portion of an interlock unit making the fiber a part of the interlocking unit. As that phrase is used herein, "protruding integral fibers" indicates integral fibers that have a portion of the fiber protruding from an interlocking unit. As that phrase is used herein, "majority external protruding integral fibers" indicates protruding integral fibers for which a majority of the fiber length is external to the rigid portion of an interlocking unit. Interlocking units having protruding integral fibers may have greater than 10% of the protruding integral fibers of as majority external protruding integral fibers. Interlocking units having protruding integral fibers may have greater than 50% of the protruding integral fibers of as majority external protruding integral fibers.

Interlocking units having protruding integral fibers may have at least 25% of the interlocking unit's total fiber length external to the rigid portion of the interlocking unit. In other cases, interlocking units having protruding integral fibers may have at least 75% of the interlocking unit's total fiber length external to the rigid portion of the interlocking unit. In still other cases, interlocking units having protruding integral fibers may have at least 85% of the interlocking unit's total fiber length external to the rigid portion of the interlocking unit.

Fiber external length, namely the length of a fiber or group of fibers that is external to the rigid portion of any units, may be at least 2 cm. In a related embodiment, the fiber external length may be at least 5 cm. In another related embodiment, the fiber external length may be at least 10 cm. In a related embodiment, the fiber external length may be at least 20 cm. In another related embodiment, the fiber external length may be at least 100 cm. In a still further related embodiment, the fiber external length may be at least 300 cm. Fiber external length may similarly be characterized as a percentage of unit length. For interlock units in which the fiber or group of fibers being characterized are integral to the unit, the "fiber external length ratio" is based on the unit length of the attached unit and may be expressed as a percentage of the unit length. When the fiber external length ratio is being characterized relative to unit length and the fibers are not integral to a particular unit, the arithmetic average of unit lengths for the set of interlock units having a unit length greater than 10 cm should be used as the standard of comparison. The fiber external length may be at least 20% of the unit length. The fiber external length may be at least 50% of the unit length. The fiber external length may also be at least 100% of the unit length. In some cases the fiber external length is at least 150% of the unit length. In other cases the fiber external length is at least 200% of the unit length. The fiber external length may even be greater than 400% of the unit length. Because interlocking units with integral fibers have fibers already attached to a unit, the length of fiber required for beneficial interactions between the fibers and the interlocking units will be less than embodiments in which the fibers are not integral. In both cases, the length of fiber included and/or the quantity of fiber included are increased to increase the angle of repose of the bulk material including the units. However, excessive quantities of fiber can cause the bulk material that includes the units to have low flowability along with causing levels of adhesion between interlocking units that complicates installation. These length descriptions may apply to individual fibers or to groupings of fibers.

As used herein, the phrase "foreign fiber" designates any fiber or group of fibers in which the majority of the mass of the fiber or group of fibers accumulated at a location apart from the current location. For example, if a plurality of fibers located on a vulnerable earthen slope were plant root fibers and 90% of the mass of those plant root fibers accumulated through growth at a place other than on the vulnerable earthen slope then the plurality of fibers would properly be characterized as foreign fiber. Any fiber group of fibers not meeting the criteria for being foreign fiber would be characterized as "local fiber." The delineation between foreign fiber and local fiber is intended to reflect whether the fiber attributes come from growing the fiber on an installation after that installation has occurred or fiber that was placed at the time of installation. Therefore, even fibers from relatively short distances, like willow trees cut from a nearby stream and placed between units would be considered foreign fiber until such time that the majority of the mass was grown as part of the installation. At completion of an installation including interlock units and fibers may have greater than 90% of fibers present being foreign fibers. Due to seeding and placement of other live plant material within various fill materials along with the growth enhancing nature of the fiber matrix created by installations, the mass of native fibers may double within 6 months of installation.

As that phrase is used herein, "positive fiber differential root growth rate" indicates a positive difference between a one-year growth in root mass in an installation having fibers as described herein as compared to a one-year growth in root mass of a comparable installation without fibers across a comparable timeframe when considering time since installation. In evaluating the fiber content of an installation, 60 cm deep, 5 cm diameter soil cores may be evaluated at the beginning and the end of a test time for an installation having fiber and an installation without fiber. In evaluating whether there is a positive fiber differential root growth rate the statistical p-value may be used to evaluate whether the fiber containing installation has a positive fiber differential root growth rate. Results indicating a positive fiber differential root growth rate with $P<0.05$ should be considered significant and confirming a positive fiber differential root growth rate. Methods of practice relating to measuring positive fiber differential root growth rate may be found in the paper Soil carbon sequestration accelerated by restoration of grassland biodiversity by Yi Yang, David Tilman, George Furey and Clarence Lehman published Feb. 12, 2019 in Nature Communications volume 10, Article number: 718 to the extent that such methods are consistent with the foregoing description. Installations described herein may have a positive fiber differential root growth rate. Similarly, a "positive fiber differential carbon capture rate" may be measured using the techniques of the positive fiber differential root growth rate method but by measuring total carbon content rather than root mass. Installations described herein may have a positive fiber differential carbon capture rate.

When evaluating "angle of repose," as that phrase is used herein, the following method should be used. Stockpiles of the relevant materials having side-slope angles should be measured using a wooden board with a mechanical inclinometer attached. A 1 m long board should be used for materials having averaged diameters <10 cm, and a 2 m long board should be used for larger materials. For materials with diameters large enough to give significantly inconsistent results using a 2 m board, a board should be selected that is long enough to create reasonably consistent results. The board should be placed at the location having the steepest descent within the central third of the slope, and the slope angle should be read from the inclinometer to the nearest degree. Ten slope angles should be measured at random locations on each stockpile and at least five stockpiles should be evaluated to determine an average.

Angle of repose is commonly evaluated with respect to a fill material and such fill materials may be heterogeneous or homogenous. For the purposes of characterization, angle of repose is sometimes used herein with reference to a single item such as an interlock unit. When angle of repose is used with reference to a single item, the angle of repose should be evaluated for a collection of items identical to the item being evaluated.

Interlock units may have an angle of repose greater than 40°. In some cases, interlock units may have an angle of repose greater than 45°. In other cases, interlock units may have an angle of repose greater than 55°. Similarly, a fill material that includes interlock units may have an angle of repose greater than 40°. A fill material that includes interlock units may have an angle of repose greater than 45°. In certain other cases, a fill material that includes interlock units may have an angle of repose greater than 55°.

An installation may have at least five fibers that are longer than the average unit length per interlock unit. In some embodiments, an installation may have at least 15 fibers that are longer than the average unit length per interlock unit.

When comparisons to average unit length are utilized, the arithmetic average of unit lengths for the set of interlock units having a unit length greater than 10 cm should be used as the basis for the average.

An installation may have fibers exceeding five times the average unit length. In some embodiments, an installation may have fibers exceeding 10 times the average unit length.

The tensile strength of fibers bears significantly on the ability of fibers described herein to maintain interlocks and create forces tending to stabilize the various interlock units and slopes. Because the scale of interlock units may vary widely, the tensile strength of fibers and groups of fibers may be characterized with reference to the weight of the rigid portion of the interlock unit (the "rigid portion weight") on which it exerts a force. As that phrase is used herein, "fiber portion" designates one or more fibers each exerting a force on a single common interlock unit such that each fiber falls within 1/20 of the unit length of the other fibers and each fiber's direction of pull on the interlock unit varies by not more than 15° from all other members of the fiber portion. The tensile strength of a fiber portion may be greater than 0.005 (0.5%) of the rigid portion weight of the interlock unit. In some examples, the tensile strength of a fiber portion may be greater than 0.010 of the rigid portion weight. In other examples, the tensile strength of a fiber portion may be greater than 0.040 of the rigid portion weight. In still other examples, the tensile strength of a fiber portion may be greater than 0.10 of the rigid portion weight.

Fibers may tangle with each other and/or form knots in ways that complicate and interconnect the various components of an installation. Fibers from a single unit or from multiple units may create a variety of forms. In some cases, the fibers touch one another. In cases where the fibers are touching one another, they may create a mesh for weave. The mesh for weave may act as a support for soil above and may produce void spaces below.

Protruding fibers, including fibers produced by methods described in U.S. Pat. No. 9,962,855 may project away from the interlock unit at an angle that normal to or within 45° above normal to the surface from which it is protruding. The methods of that patent may be modified to suit the requirements of this disclosure by including fibers in the solid mix having sufficient length to meet various criteria described herein. A majority of protruding fibers may protrude within 75° of normal to the surface from which they protrude. Protruding fibers may occur without the presence of fiber against form artifacts. "Fiber against form artifacts", as that phrase is used herein, are markings along the rigid surface of an interlock unit indicating a fiber was pressed between the interlock unit and a form while the rigid portion of the interlock unit was being formed.

The various networks and meshes formed by the fibers may both act as a restraint on the erosion of material from an installation and may serve as a trap for the accretion of sediment, soil and other earthen materials.

In examples involving interlock units with protruding integral fibers, a great number of fill types may be used. Combined fills may be used in which the interlock units are placed or delivered with other fill materials. Such combined fills may present a different profile of fiber interactions than the separate application of the fill materials. Interlock units may be placed in an installation separate from other fill materials followed by the other fill materials being spread over the interlock units. The spreading of fill material over interlock units having protruding integral fibers may have the effect of creating void spaces beneath many of those fibers especially in places where the fibers are combined into networks of individual fibers that cross one another. Void spaces may also tend to form in areas beneath the interlock units and areas otherwise shielded by the interlock units. Further, void spaces may occur at greater rates below fibers that are under tension due to those fibers ability to bear weight from above. The application of fill material across a length of fiber or fibers may create a situation where the fill material takes up slack in the fiber(s) ultimately causing tension on the fiber(s) and that tension on the fiber(s) may in turn support fill materials, cause void space below the tensioned fiber(s), and/or create tension on one or more interlock units in one or more of the types of tension described herein.

The ability of fibers and interlock units described herein to create void space may lead to installations having high porosity. "Porosity" as that term is used herein, represents the fraction of total volume taken up by pore space which may be represented by a percentage. The porosity of all fill materials applied as part of an installation including interlock units may be greater than 35%. In certain instances, the porosity of all fill materials applied as part of an installation including interlock units may be greater than 40%. In certain instances, the porosity of all fill materials applied as part of an installation including interlock units may be greater than 50%. The porosity of all fill materials applied as part of an installation excluding interlock units may be greater than 35%. In certain instances, the porosity of all fill materials applied as part of an installation excluding interlock units may be greater than 40%. In certain instances, the porosity of all fill materials applied as part of an installation excluding interlock units may be greater than 50%. Evaluations of porosity described herein are intended to include the substantial voids created beneath and between fibers and interlock units. The high porosity of installations described herein may lead to better water retention aiding in the handling of storm water and other runoff.

Fill materials used in conjunction with interlock unit may include sand, soil, topsoil, seeds, rocks, vermiculite, willow segments, and a large variety of conventional construction fill materials. Grades of rocks may be included as a portion of a fill material or as an independent fill material. The grade of rock may be selected from rock classifications The grade of rock may be selected from rock classifications and gradations such as those recognized by various state departments of transportation such as Louisiana DOTD. Selection of the appropriate rock riprap, and fill materials from those specifications and otherwise, may be done based on engineering standards and judgement. For example, a particular type of interlock unit—that may be specified by size, shape and fiber characteristics—may be evaluated such that design criteria, tables, graphs and/or other design aids may be supplied to engineers and other designers for the purpose of selecting complementary fill materials that meet the underlying design criteria of a project. Fill materials used may include seeds that germinate separate from the installation site prior to placement of the fill whether or not the fill materials include interlocking units.

Installation described herein may include dirt in the fill that includes the interlock units. Installations described herein may be applied as a single layer of fill.

As an example, an installation or stabilized slope may be prepared on an embankment. The embankment may be adjacent to and run parallel to a road such that runoff from the road flows down the embankment. The embankment may be prepared to include a 100% grade area having roughly a 2 m rise and a 2 m run. The embankment may be prepared for the application of interlock units using earth working equipment such as bulldozers or the interlock units may be installed without preparatory earthwork. A collection of 70 cm tall tetrapod configuration interlock units with concrete as the rigid structural element and basalt fibers may be installed by a dump truck unloading the interlock units from the top of the slope such that they migrate down the slope and pile up in a configuration resembling that depicted in FIG. 7. Although the chaotic nature of bulk handling delivery creates either random or quasi-random orientations and relationships amongst the interlock units, the configuration of interlock units on the slope may be loosely characterized as having layers with one layer of interlock units resting on the slope and another layer of interlock units resting on and interlocked with the first layer of interlock units. The thickness of the interlock units as applied may be between 90 and 130 cm as measured from the underlying slope in the non-vertical direction normal to the original 50% grade. The individual interlock units may, for example, have and the average of 1000 protruding integral fibers per unit and the protruding integral fibers may have an average length of 2 m. After original placement of the interlock units on the slope, the interlock units may be moved or adjusted by earthmoving or other similar equipment. However, with careful placement, little or no adjustment to the interlock units may be needed. The interlock units and associated fibers will tend to associate and interact in a way that stabilizes the slope based on the original placement of those interlock units without the need for labor intensive stabilizing work. The described installation may be left as is and regarded as a completed installation. In that case, the structured network of concrete and fiber would tend to gather soil, debris, seeds, and other matter between the interlock units and ultimately create a base for plant growth along the slope which would add further stability to the slope over time. Alternatively, the installation may be completed by adding one or more additional fills including soil, gravel, and seeds such as grass seed. Due to the complex structured network of the interlock units including associated fibers and the ability of those interlock units to add living and nonliving materials by accretion, the fill applied over the interlock units may cover the interlock units based on preference, but the depth of additional fill may be based on preference.

Interlock units may come in a variety of sizes. Unit length may, for example, be 0.80 m with certain examples falling between 0.05 and 8.00 m and a significant number of those examples falling between 0.40 and 4.50 m.

Loose Fiber Examples

Installations similar to the installations involving interlock units described above may be executed using interlock units that have little to no protruding integral fibers. In such cases, Interlock units may be part of a common fill that contains loose fibers. For examples where loose fibers are the primary fibers creating stabilizing tension for the vulnerable earthen slope the length of the fibers may be three times the length of fibers used in examples containing protruding integral fibers. Accordingly, each example directed to protruding integral fibers has a loose fiber equivalent example in which the relevant fiber length is tripled. These examples should be considered part of the disclosure without explicit repetition of each characterization of fiber length. Loose fibers interact with the interlock units in various ways including snags, tangles with other fibers, getting pinned under interlock units, being buried by non-interlock unit fill materials, getting pinned between interlock units, tangling around interlock units, wrapping around the interlock units and interactions with other fibers. The use of interlock units without protruding integral fibers may be desirable due to the ability to produce interlock units at lower cost. In one embodiment, the collection of interlock units would be mixed with fibers and other fill material such as soil so that bulk delivery of the common fill creates interactions between the fibers and the interlock units throughout the fill. In other embodiments, some or all of the fiber could be placed as part of a subsequent fill and some or all of the non-fiber non-interlock unit materials could be placed as part of a subsequent fill with the subsequent fill optionally containing both fiber and non-fiber non-interlock unit materials.

Figure 13:
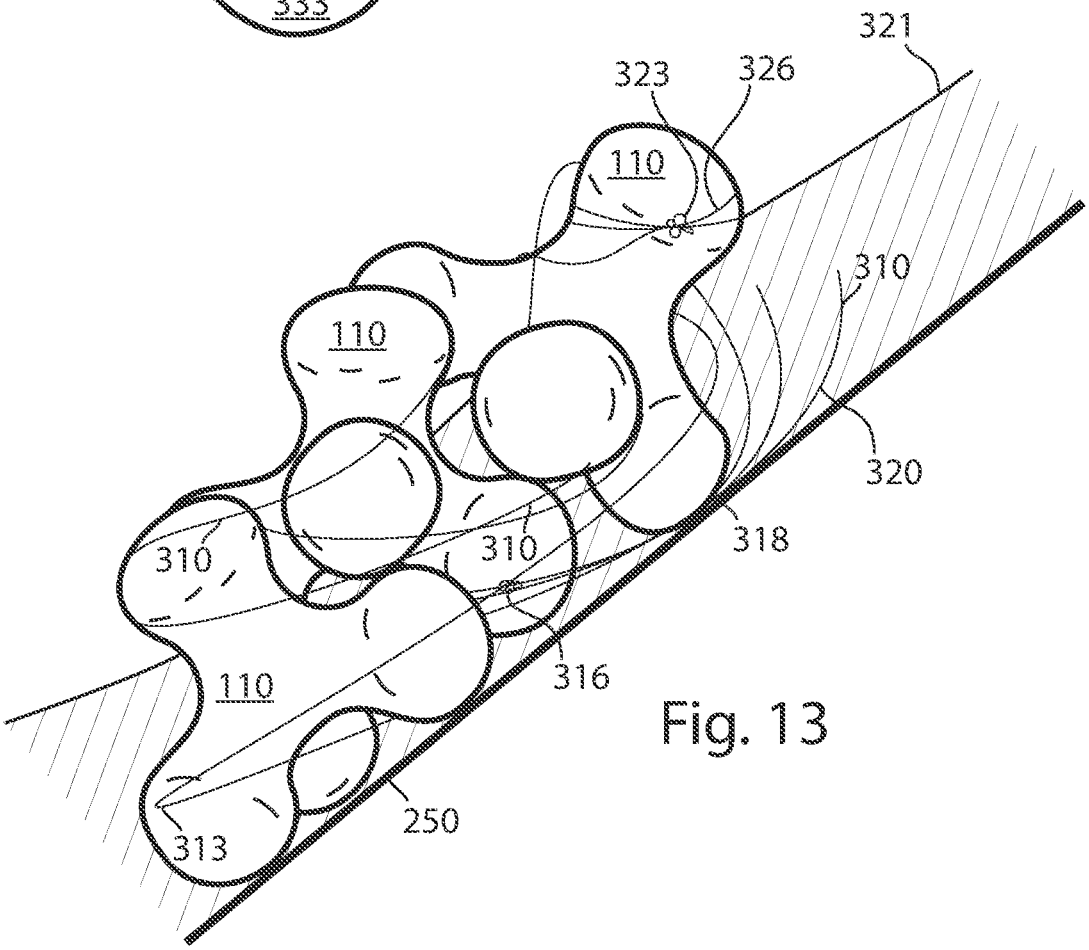
FIG. 13 depicts loose fibers interacting with interlock units on a vulnerable earthen slope.

Referring to FIG. 13 of the drawings, Loose fibers 310 may become involved in Snags 313, Tangles 316 with other fibers, Pins 318 under interlock units, Burial 320 by Non-interlock unit fill materials 321, Tangling 323 with Interlock units 110, and Wrapping 326 around Interlock units 110. Such interactions may be common in loose fiber installations. Non-fiber non-interlock fill material 330 may for example be soil and may include plant matter such as seeds. The installation configuration depicted may be placed on Vulnerable earthen slope 250 as a common fill including Non-fiber non-interlock fill material 330, Interlock units 110, and Loose fibers 310. These types of interactions would also be present in protruding integral fiber interlock unit installations as well. Protruding integral fiber interlock unit installations would be less reliant on these types of interactions due to the fact that integral fibers are generally securely attached.

Installations may also be prepared in which the interlock units are a mixture of interlock units with protruding integral fibers and interlock units without protruding integral fibers. When a substantial portion of the interlock units are interlock units without protruding integral fibers the remaining interlock units may have fibers of greater length or number to provide equivalent stability.

As an example, an installation or stabilized slope may be prepared on an embankment. The embankment may be a coastal slope that descends through a tidal area. The embankment may be prepared to include an 80% grade area having roughly 8 m rise over a 10 m run. The embankment may be prepared for the application of interlock units using earth working equipment such as bulldozers or the interlock units may be installed without preparatory earthwork. A collection of 1.2 m tall (1.3 m unit length) tetrapod configuration interlock units with concrete as the rigid structural element, loose basalt fibers, soil, and seed may be installed as a single fill by a dump truck unloading from the top of the slope such that they migrate down the slope and pile up in a configuration resembling that depicted in FIG. 7. The thickness of the interlock units as applied may be between 1.3 and 2.2 m as measured from the underlying slope in the non-vertical direction normal to the original 80% grade. There may be 1000 loose fibers per interlock unit and fibers may have an average length of 8 m. After original placement of the interlock units on the slope, the interlock units may be moved or adjusted by earthmoving or other similar equipment. However, with careful placement, little or no adjustment to the interlock units may be needed. The interlock units and associated fibers will tend to associate and interact in a way that stabilizes the slope based on the original placement of those interlock units without the need for labor intensive stabilizing work. The described installation may be left as is and regarded as a completed installation. In that case, the structured network of concrete and fiber would tend to gather soil, debris, seeds, and other matter between the interlock units and ultimately create a base for plant growth along the slope which would add further stability to the slope over time. Accretion characteristics may be similar installations involving protruding integral fiber interlock units. The selection and use of additional fill with the installation may also be like installations involving protruding integral fiber interlock units.

Further Examples

Many examples described herein relate to slopes and vulnerable earthen slopes. While features described herein have substantial utility for the stabilizing of such slopes, slopes having grades of 20% and below, including level surfaces may benefit from the stabilization techniques described herein. This may be particularly true when the movement of water creates erosive and otherwise disruptive forces. Examples described herein for the protection of lower slope surfaces may proceed substantially identically to the examples directed to vulnerable earthen slopes with the thickness of the application of the interlock units being reduced. Example thickness reductions maybe 10% or 20%.

Interlock units may be printed using techniques described in U.S. Pat. No. 9,962,855. Printed interlock units may be printed using those and other pixel type techniques and pixel diameter may for example be 6.0 cm with certain examples falling between 0.5 and 40.0 cm and a significant number of those examples falling between 3.3 and 23.0 cm.

Various embodiments described herein may be handled by bulk handling equipment including dump trucks, bulldozers, and excavators. The bulk handling of interlock units and fibers described herein create economic advantages over the placement of other types of stabilizing units which commonly involve unit-by-unit orientation. Accordingly, one manner of characterizing the placement technique is the absence of unit-by-unit orientation. In many cases, the majority of interlock units are placed without unit-by-unit orientation.

As interlocking units are moved into position their orientation and position may move relative to one another and with respect to the ground simultaneously. The interlocking units may simultaneously rotate around different axes. The general motion associated with the placement of the units may be that of bulk placement and bulk material handling. The bulk handling motion of the interlocking units may be characterized loosely as "flow" with the understanding that the movement of such solid materials in most cases is not fluidized. As such, any motion described as "flow" and its related forms herein denotes a use of that term broad enough to encompass motions that resemble fluid motion but that do not meet technical definitions for a fluidized solid.

As that phrase is used herein "collective heterogeneous motion" designates motion of objects in which each object undergoes simultaneous motion relative to each other and relative to the ground without organization of the motion of the objects relative to each other. Dumping of a collection of objects by a dump truck would in most cases qualify as collective heterogeneous motion. Similarly, bulldozing a collection of objects would in most cases qualify as collective heterogeneous motion. Installations including interlock units installed according to the descriptions herein may be installed such that the interlock units undergo collective heterogeneous motion during the installation. In certain examples, most of the interlock units that are part of an installation undergo collective heterogeneous motion during the installation process.

Preparation techniques that create interlock units having higher static coefficient of friction may be utilized including U.S. Pat. No. 9,962,855. The surface of an interlock unit may have at least a portion with a static coefficient of friction exceeding 0.3 when interacting with a surface from an identical interlock unit. In some cases, the static of efficient of friction exceeds 0.7 and in still other cases the static coefficient of friction exceeds 0.85.

Interlock units and the associated fibers described herein may be used in a variety of circumstances where issues relating to erosion, slope stability or both present challenges. For that reason, the embodiments described herein could be used in association with almost any waterway including creeks, ditches, rivers, etc. Embodiments described herein may be used on slopes with a grade exceeding 25%, slopes with a grade exceeding 35%, and even slopes with a grade exceeding 50%. Further, the installations described herein may simultaneously resist erosive and destructive forces from water while protecting slopes of those higher grades. Coastal zones, marshes, and wetlands may also be protected along with tidal areas. The maximum stable grade of the fill including the interlock units may be greater than that of conventional riprap.

The unit length of the interlock unit may be at least 2 cm. In a related embodiment, the unit length of the interlock unit may be at least 5 cm. In a related embodiment, the unit length of the interlock unit may be at least 10 cm. In another related embodiment, the unit length of the interlock unit may be at least 20 cm.

Installation of embodiments described herein may require less labor-intensive grading than equivalent installations of conventional riprap. Installation of embodiments described herein may require less labor-intensive compaction than equivalent installations of conventional riprap. Installation of embodiments described herein may require less labor-intensive geotextile application than equivalent installations of conventional riprap. Embodiments described herein may have greater capacity to absorb nutrient runoff as compared to equivalent installations of conventional riprap. For a given slope on which interlock units are installed, on average the interlock units may have a lower propensity to roll than riprap of equivalent mass.

Embodiments described herein may include a diversity of graded stone and for example may include two, three, or more separate grades of stone. Fill including the interlock units may include native plant species and may further exclude non-native and invasive plant species.

The completed installation including interlock unit may be completely plastic free.

Installations of embodiments described herein may have the seeds applied as a common fill with the interlock units. Installations of embodiments described herein may have non-seed growing plant matter applied as a common fill with the interlock units. Installations of embodiments described herein may be further stabilized in the month following the completion of installation by additional plant root growth.

Installations described herein may be completed without the application of metal fasteners like stakes. Installations described herein may be completed without the application of plastic or concrete mats. Installations described herein may be completed using only natural fill materials as supplemental to the interlock units. Installations described herein may be prepared without terracing. Installations described herein may be applied without unrolling fibrous mats at the installation site. Final placement of interlock units may occur without a predefined unit placement pattern. Placement of fill that includes interlock units may occur without the presence of securing hardware such as stakes. Installations may be characterized by a lack of manually oriented secure devices such as geotextile mats, retaining walls, retaining wall blocks, and plastic grids.

Installations described herein may be completed without cast in place concrete. Installations described herein may be completed without precast concrete. Installations described herein may be completed without plastic frames.

The surface of interlock units may include features conducive to interlocking and grabbing the soil or other interlock units such as cleats, knobs, ridges, etc. These features would generally have a dimensional scale less than one quarter of the unit length such that they can engage with other interlock units, soil, and other items on a scale smaller than the generalized shape of the interlock unit. Such features generally provide both interlock protrusions and interlock recesses further enhancing interlocks and adding to overall stability of installations.

The presence of fibers and resistance to compaction creates soil conditions that may have higher oxygen content relative to soils without those fibers. Such oxygenation may promote vegetation root growth which in turn stabilizes the structure over time.

One or more interlock units may be prepared such that they are permanently attached to one another by way of a cable, fiber or collection of fibers. In such situations, the angle of repose may be greater than in similar situations without permanent attachment.

Stabilized slopes as described herein may, for example, comprise a first interlock unit; a second interlock unit; a third interlock unit; a plurality of fibers; and a vulnerable earthen slope such that the first interlock unit, the second interlock unit, the third interlock unit, and the plurality of fibers are situated on the vulnerable earthen slope; the first interlock unit has a unit length of at least 10 cm; a first fiber portion exerts a first tension force on the first interlock unit; the first fiber portion comprises at least one fiber from the plurality of fibers; the first tension force exceeds 0.5% of a total first unit weight of the first interlock unit; the first fiber portion is foreign fiber; and the first interlock unit and the second interlock unit are interlocked. In a related example, the stabilized slope may also have at least one fill material, wherein the at least one fill material occupies a majority of the space between the first interlock unit and the second interlock unit and the at least one fill material comprises soil. In a related example, the at least one fill material comprises seeds. In a related example, the first tension force resists disengagement of the interlock between the first interlock unit and the second interlock unit. In a related example, the first interlock unit has an angle of repose which is greater than 45°. In a related example, the stabilized slope further comprises biochar. In a related example, the first fiber portion is at least one half the unit length of the first interlock unit. In a related example, the first fiber portion is an integral part of the first interlock unit.

Methods of earthwork described herein may, for example, comprise placing a fill material on a vulnerable earthen slope; such that the fill material comprises a first interlock unit, a second interlock unit, a third interlock unit, and a plurality of fibers; such that a first fiber portion exerts a first tension force on the first interlock unit; the first interlock unit has a unit length of at least 10 cm; the first fiber portion comprises at least one fiber from the plurality of fibers; and the first interlock unit, second interlock unit, and the third interlock unit undergo collective heterogeneous motion during the placing of the fill material. In a related example, the fill material may have a porosity of at least 40%. In a related example, the fill material may comprise soil and the first fiber portion may exert a force that opposes compaction of the soil beneath the first fiber portion. In a related example, a void space may be present beneath the first fiber portion. In a related example, the fill material may be placed by a machine selected from a dump truck and a bulldozer. In a related example, the fill material may contain biochar. In a related example, the fill material may have an angle of repose which is greater than 45°. In a related example, the fill material may contain seeds. In a related example, the first interlock unit may be interlocked with the second interlock unit after the placing of the fill material. In a related example, the second interlock unit may exert downward pressure on the first fiber portion. In a related example, the first interlock unit may be interlocked with the second interlock unit after the placing of the fill material and the first tension force may resist disengagement of the interlock between the first interlock unit and the second interlock unit. In a related example, the first fiber portion may be at least one half the unit length of the first interlock unit.

Headings are provided for readability and are not intended to limit the applicability of teachings found under individual headings. The above-described embodiments have a number of independently useful individual features that have particular utility when used in combination with one another including combinations of features from embodiments described separately. There are, of course, other alternate embodiments which are obvious from the foregoing descriptions, which are intended to be included within the scope of the present application.

The invention claimed is:

1. A stabilized slope comprising:

a. a first interlock unit;
b. a second interlock unit;
c. a third interlock unit;
d. a plurality of fibers; and
e. a vulnerable earthen slope;
f. wherein the first interlock unit, the second interlock unit, the third interlock unit, and the plurality of fibers are situated on the vulnerable earthen slope;
g. wherein the first interlock unit has a unit length of at least 10 cm;
h. wherein a first fiber portion exerts a first tension force on the first interlock unit;
i. wherein the first fiber portion comprises at least one fiber from the plurality of fibers;
j. wherein the first tension force exceeds 0.5% of a total first unit weight of the first interlock unit;
k. wherein the first fiber portion is foreign fiber; and
l. wherein the first interlock unit and the second interlock unit are interlocked.

2. The stabilized slope of claim 1 further comprising at least one fill material, wherein the at least one fill material occupies a majority of the space between the first interlock unit and the second interlock unit and the at least one fill material comprises soil.

3. The stabilized slope of claim 2 wherein the at least one fill material comprises seeds.

4. The stabilized slope of claim 1 wherein the first tension force resists disengagement of the interlock between the first interlock unit and the second interlock unit.

5. The stabilized slope of claim 1 wherein the first interlock unit has an angle of repose which is greater than 45°.

6. The stabilized slope of claim 1 further comprising a material selected from biochar and vermiculite.

7. The stabilized slope of claim 1 wherein the first fiber portion is at least one half the unit length of the first interlock unit.

8. The stabilized slope of claim 1 wherein the first fiber portion is an integral part of the first interlock unit.

9. A method earthwork comprising:

a. placing a fill material on a vulnerable earthen slope;

b. wherein the fill material comprises i. a first interlock unit, ii. a second interlock unit, iii. a third interlock unit, and iv. a plurality of fibers;

c. wherein a first fiber portion exerts a first tension force on the first interlock unit;

d. wherein the first interlock unit has a unit length of at least 10 cm;

e. wherein the first fiber portion comprises at least one fiber from the plurality of fibers; and f. wherein the first interlock unit, second interlock unit, and the third interlock unit undergo collective heterogeneous motion during the placing of the fill material.

10. The method of claim 9 wherein the fill material has a porosity of at least 40%.

11. The method of claim 9 wherein the fill material comprises soil and the first fiber portion exerts a force that opposes compaction of the soil beneath the first fiber portion.

12. The method of claim 9 wherein a void space is present beneath the first fiber portion.

13. The method of claim 9 wherein the fill material is placed by a piece of bulk handling equipment.

14. The method of claim 9 wherein the fill material further comprises a material selected from biochar and vermiculite.

15. The method of claim 9 wherein the fill material has an angle of repose which is greater than 45°.

16. The method of claim 9 wherein the fill material further comprises seeds.

17. The method of claim 9 wherein the first interlock unit is interlocked with the second interlock unit after the placing of the fill material.

18. The method of claim 9 wherein the second interlock unit exerts downward pressure on the first fiber portion.

19. The method of claim 9 wherein the first interlock unit is interlocked with the second interlock unit after the placing of the fill material and the first tension force resists disengagement of the interlock between the first interlock unit and the second interlock unit.

20. The stabilized slope of claim 9 wherein the first fiber portion is at least one half the unit length of the first interlock unit.

* * * * *